US011490738B2

(12) United States Patent
Lin

(10) Patent No.: US 11,490,738 B2
(45) Date of Patent: Nov. 8, 2022

(54) ELECTRICAL BED

(71) Applicants: Wen-Hung Lin, Kaohsiung (TW); Ai. Sleep Co., Ltd., Taipei (TW)

(72) Inventor: Wen-Hung Lin, Kaohsiung (TW)

(73) Assignees: Wen-Hung Lin, Kaohsiung (TW); AI. SLEEP CO., LTD., Taipei (TW)

( * ) Notice: Subject to any disclaimer, the term of this patent is extended or adjusted under 35 U.S.C. 154(b) by 20 days.

(21) Appl. No.: 16/932,214

(22) Filed: Jul. 17, 2020

(65) Prior Publication Data

US 2021/0120963 A1 Apr. 29, 2021

Related U.S. Application Data

(60) Provisional application No. 62/927,243, filed on Oct. 29, 2019.

(51) Int. Cl.
*A47C 20/04* (2006.01)
*A47C 19/04* (2006.01)

(52) U.S. Cl.
CPC ..... *A47C 20/04* (2013.01); *A47C 19/045* (2013.01)

(58) Field of Classification Search
CPC ..... A47C 20/04; A47C 19/045; A47C 20/041; A47C 19/02
USPC ..... 5/616
See application file for complete search history.

(56) References Cited

U.S. PATENT DOCUMENTS 942,354 A * 12/1909 Ryan ..... A47C 20/027 5/617
1,464,876 A * 8/1923 King ..... B60J 3/02 296/97.8
2,172,941 A * 9/1939 Manning ..... A61G 13/02 5/616
2,247,516 A * 7/1941 Murray ..... A47C 20/041 5/616
2,308,592 A * 1/1943 Drexler ..... A61G 5/006 5/616
2,819,474 A * 1/1958 Olsen ..... A47C 20/041 5/616
2,831,200 A * 4/1958 Olsen ..... A61G 7/018 5/616

(Continued)

FOREIGN PATENT DOCUMENTS

CN 204015713 U 12/2014
DE 19532671 A * 8/2000 ..... A47C 20/04
KR 20010094982 A * 11/2001 ..... A47C 17/54

*Primary Examiner* — David R Hare
*Assistant Examiner* — Luke Hall
(74) *Attorney, Agent, or Firm* — Muncy, Geissler, Olds & Lowe, P.C.

(57) ABSTRACT

An electrical bed is provided. The electrical bed includes a frame, a plurality of bed plates, a first connector and a first driving unit. The frame includes a plurality of bed stands, and the bed plates are arranged on the bed stands. The first connector includes a first rotating member, a first connecting arm, a first transmission bar and a second connecting arm. The first rotating member is pivotally connected with the first connecting arm, and the first connecting arm is sleeved with the first transmission bar and fixed relative to each other, and the second connecting arm is sleeved with the first transmission bar and fixed relative to each other. The first driving unit is arranged to drive the first transmission bar to rotate and adjust one of the bed plates.

10 Claims, 5 Drawing Sheets

(56) References Cited

U.S. PATENT DOCUMENTS 2,996,732 A * 8/1961 Draper ..... A47C 20/08 5/616
3,051,965 A * 9/1962 Szemplak ..... A47C 20/042 5/616
3,089,150 A * 5/1963 Briggs ..... A47C 20/08 5/616
3,191,196 A * 6/1965 Holm ..... A61G 7/015 5/616
3,239,853 A * 3/1966 MacDonald ..... A61G 7/16 5/616
3,278,952 A * 10/1966 Holm ..... A47C 20/08 5/616
4,385,410 A * 5/1983 Elliott ..... A61G 7/002 5/616
4,776,380 A * 10/1988 Lester ..... E06B 9/26 160/134
5,737,786 A * 4/1998 Yamamoto ..... A61G 7/02 5/81.1 R
6,905,177 B1 * 6/2005 Murillo ..... B60B 7/06 301/37.104
7,188,658 B1 * 3/2007 Nordstrom ..... E06B 9/32 160/134
7,784,877 B1 * 8/2010 Castillo ..... B60B 7/04 301/37.104
8,136,568 B2 * 3/2012 DeBauche ..... E06B 9/26 160/134
8,556,351 B1 * 10/2013 Uhlin ..... B60B 7/08 301/37.104
9,140,525 B2 * 9/2015 Yakoub ..... F41H 5/02
9,462,908 B2 * 10/2016 Haen ..... E06B 9/24
9,993,089 B1 * 6/2018 Tavares ..... A47C 19/025
10,538,908 B1 * 1/2020 Wilson ..... E04H 9/14
2006/0143792 A1 * 7/2006 No ..... A42B 1/0185 2/195.2
2007/0056986 A1 * 3/2007 Berman ..... F41B 9/0018 222/79
2008/0178388 A1 * 7/2008 Schermel ..... A47C 27/001 5/613
2010/0186168 A1 * 7/2010 Harrison ..... A47C 20/041 5/616
2012/0297543 A1 * 11/2012 Robertson ..... A47C 20/041 5/616
2014/0103679 A1 * 4/2014 You ..... B60J 1/2091 296/97.6
2015/0007391 A1 * 1/2015 Xu ..... A61G 7/015 5/616
2015/0196443 A1 * 7/2015 Tarquinio ..... A47C 21/00 5/613
2016/0120327 A1 * 5/2016 Shimada ..... A47C 19/045 5/11
2016/0128883 A1 * 5/2016 Robertson ..... A47C 7/50 5/613
2017/0100277 A1 * 4/2017 Ke ..... A61F 5/56
2017/0166104 A1 * 6/2017 Gilmore ..... A47C 19/045

* cited by examiner

ELECTRICAL BED

CROSS REFERENCE TO RELATED APPLICATION

This application claims the benefit of filing date of U.S. Provisional Application Ser. No. 62/927,243 filed on Oct. 29, 2019. The entirety of said Provisional Application is incorporated herein by reference.

BACKGROUND OF THE INVENTION

1. Field of the Invention

The present invention relates to an electrical bed. More particularly, the present application relates to an electrical bed for adjusting bed plates.

2. Description of Related Art

Generally, everyone needs adequate sleep, however, partial of people may suffer from light sleep, interrupted sleep apnea syndrome, which causes them to have insomnia, daytime naps, fatigue, lethargy, irritability, or depression. Therefore, an electrical bed capable of adjusting different angles to meet user's sleeping position is required.

SUMMARY OF THE INVENTION

An aspect of the disclosure is to provide an electrical bed. The electrical bed includes a frame, a plurality of bed plates, a first connector and a first driving unit. The frame includes a plurality of bed stands and the bed plates disposed on the bed stands. The first connector includes a first rotating member, a first connecting arm, a first transmission bar and a second connecting arm, wherein the first rotating member is pivotally connected with the first connecting arm; the first connecting arm is sleeved with the first transmission bar and fixed relative to each other, and the second connecting arm is sleeved with the first transmission bar and fixed relative to each other; the first rotating member abuts against one of the bed plates. The first driving unit is fixedly connected with one of the bed stands and pivotally connected with the second connecting arm, wherein the first driving unit is arranged to drive the first transmission bar to adjust one of the bed plates.

The foregoing and other objects, advantages, and novel features of the invention will become more apparent from the following detailed description when taken in conjunction with the accompanying drawings.

DETAILED DESCRIPTION OF THE PREFERRED EMBODIMENT

It will be understood that, in the description herein and throughout the claims that follow, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, words indicating direction used in the description of the following embodiments, such as "above," "below," "left," "right," "front" and "back," are directions as they relate to the accompanying drawings. Therefore, such words indicating direction are used for illustration and do not limit the present disclosure.

It will be understood that, in the description herein and throughout the claims that follow, unless otherwise defined, all terms (including technical and scientific terms) have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

Figure 1:
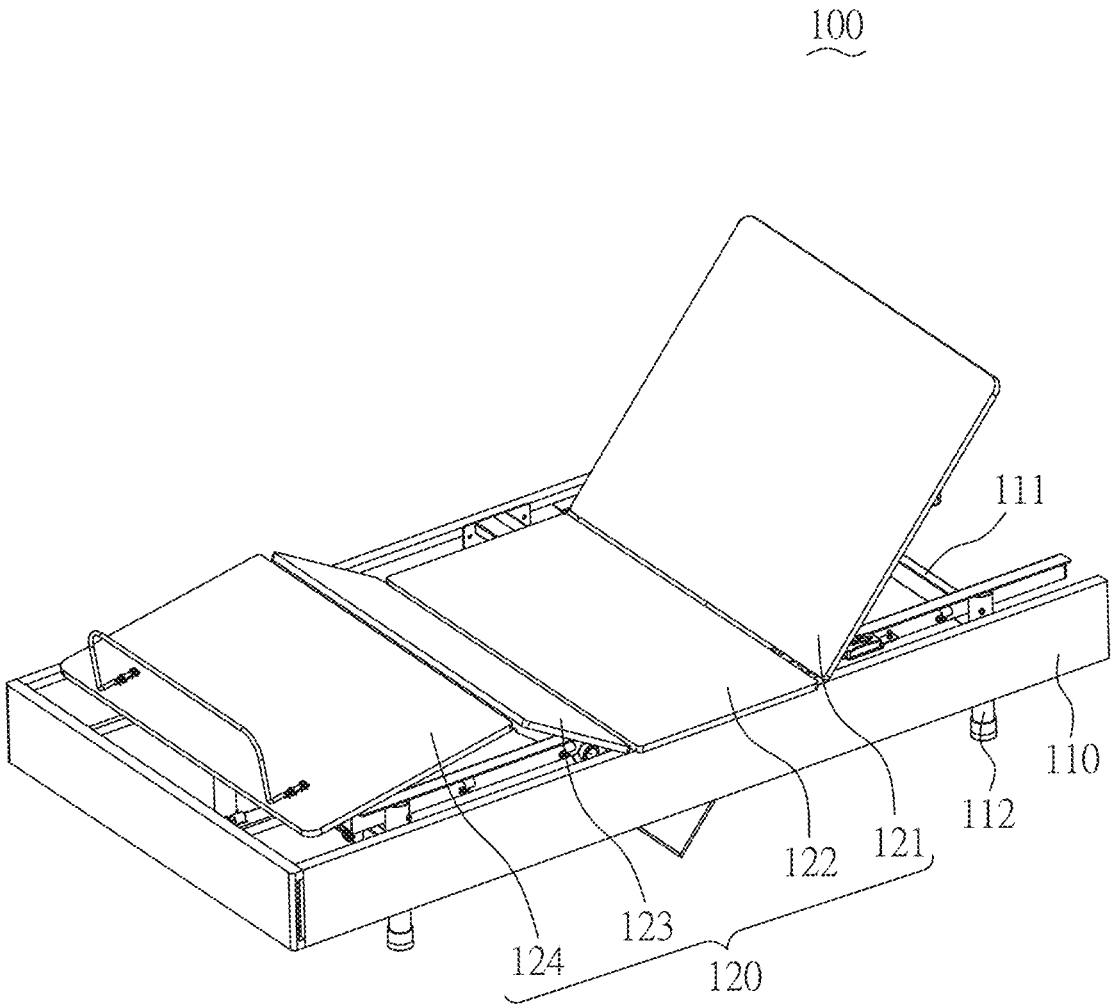
FIG. 1 is a stereogram illustrating an electrical bed according to an embodiment of the disclosure.
Figure 2:
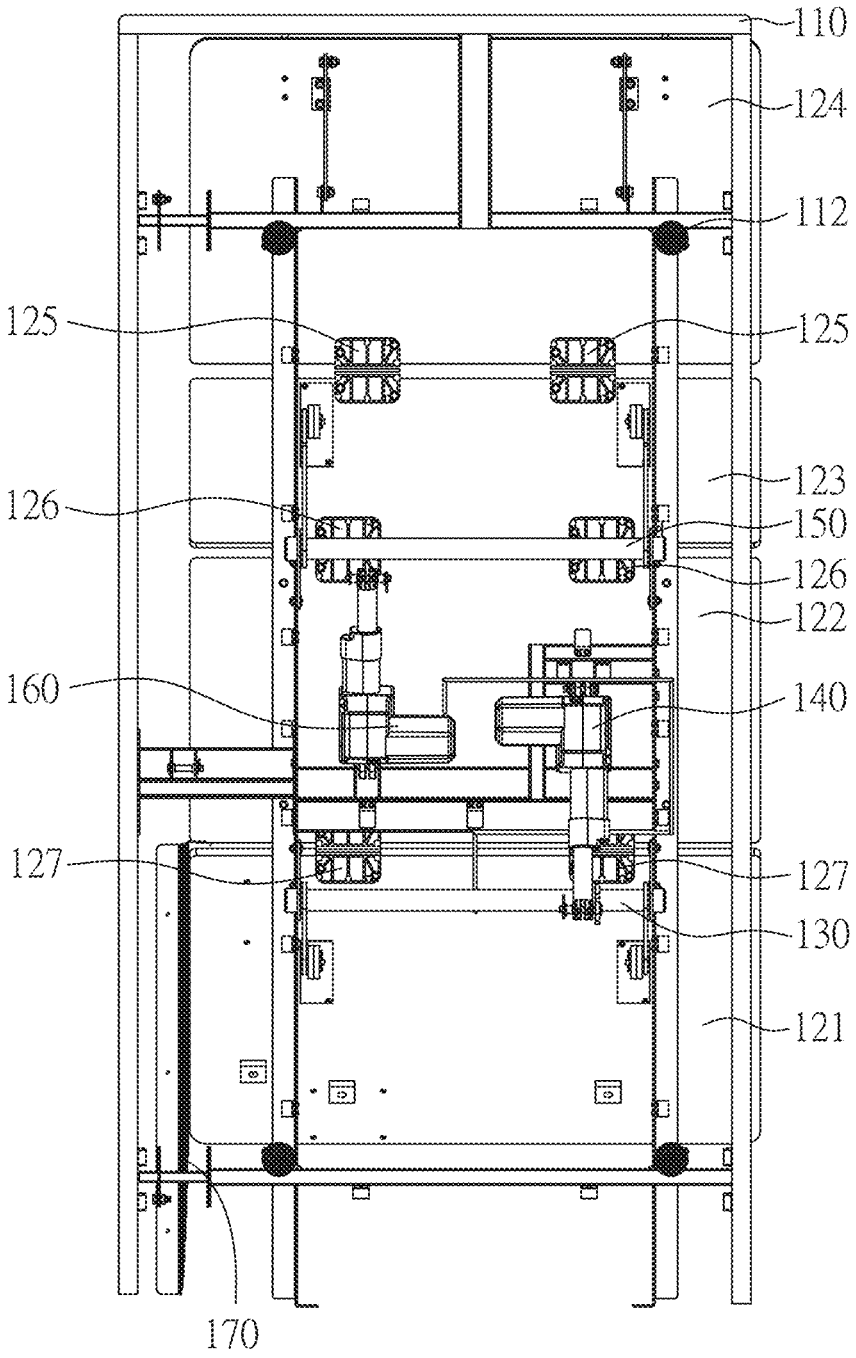
FIG. 2 is a bottom explosive view illustrating an electrical bed according to an embodiment of the disclosure.

Reference is made to FIG. 1 and FIG. 2. FIG. 1 is a stereogram illustrating an electrical bed 100 according to an embodiment of the disclosure, and FIG. 2 is a bottom explosive view illustrating an electrical bed 100 according to an embodiment of the disclosure. As shown in FIG. 1 and FIG. 2, the electrical bed 100 includes a frame 110, a plurality of bed plates 120, a plurality of connectors 130 and 150, a plurality of driving units 140 and 160 and a blocker member 170. The frame 110 includes a plurality of bed stands 111 and a plurality of bed feet 112. The plurality of bed plates 120 include the bed plates 121, 122, 123 and 124, and the bed plates 121, 122, 123 and 124 are disposed on the bed stands 111. The bed plate 121 is pivotally connected to the bed plate 122 through the hinges 125. The bed plate 122 is pivotally connected to the bed plate 123 through the hinges 126. The bed plate 123 is pivotally connected to the bed plate 124 through the hinges 127. It is noticed that, it can utilized that multiple hinges to connect two bed plates, and in the embodiment shown in FIG. 2, it is utilized two hinges to connect two bed plates. However, the disclosure is not limited thereto.

Figure 3:
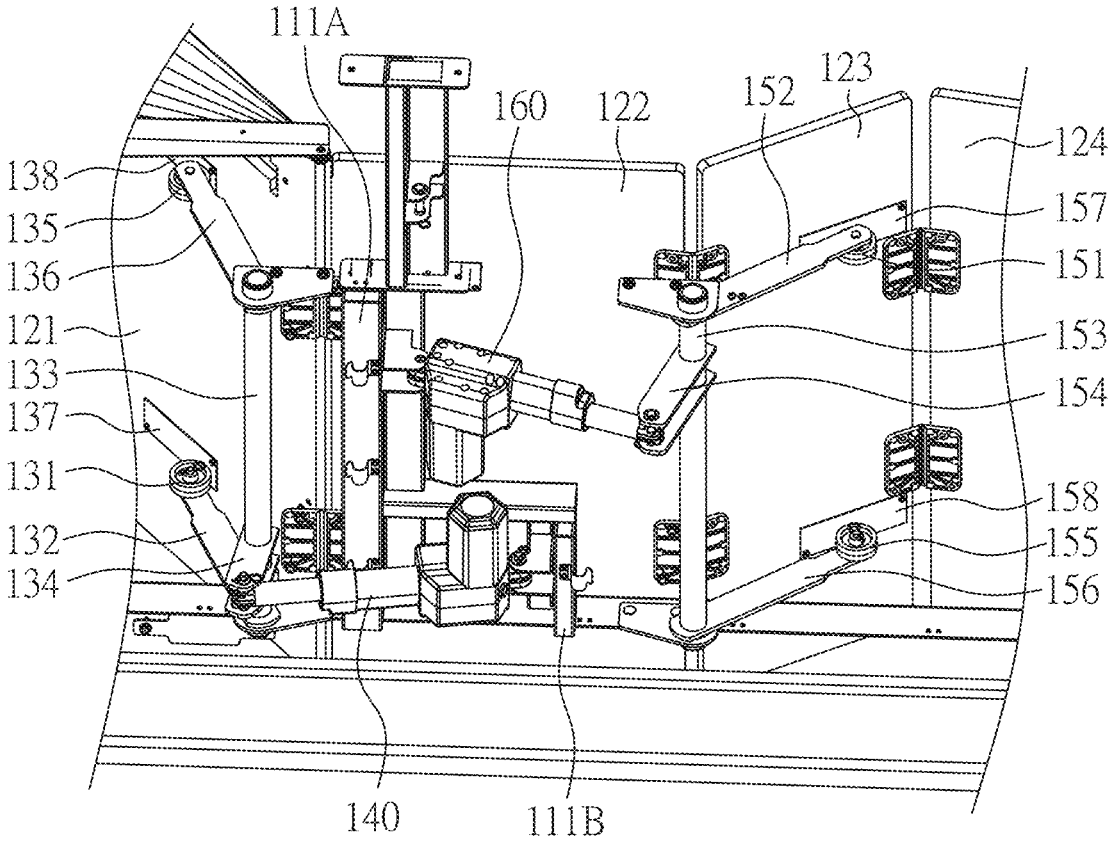
FIG. 3 is a partially enlarged stereogram illustrating an electrical bed according to an embodiment of the disclosure.

Reference is made to FIG. 3, which is a partially enlarged stereogram illustrating an electrical bed 100 according to an embodiment of the disclosure. As shown in FIG. 3, the connector 130 includes a rotating member 131, multiple connecting arms 132 and 134, a transmission bar 133, an auxiliary rotating member 135, an auxiliary connecting arms 136, a limit part 137 and an auxiliary limit part 138. The rotating member 131 is pivotally connected with the connecting arm 132. The connecting arm 132 is sleeved with the transmission bar 133 and fixed relative to each other. The connecting arm 134 is sleeved with the transmission bar 133 and fixed relative to each other. The auxiliary rotating member 135 is pivotally connected to the auxiliary connecting arm 136. The auxiliary connecting arm 136 is sleeved with the transmission bar 133 and fixed relative to each other. The driving unit 140 is arranged to drive the transmission bar 133 to rotate, and the transmission bar 133 is arranged to drive the connecting arm 132 and the auxiliary connecting arm 136 to adjust the bed plate 121. It is noticed that, the transmission bar 133, the connecting arms 132 and 134 and the auxiliary connecting arm 136 are relatively fixed to each other. Therefore, when the driving unit 140 is actuated, the transmission bar 133 is driven to rotate and the connecting arm 132 and the auxiliary connecting arm 136 are driven to adjust the raising or lowering of the bed plate 121.

Afterwards, the limit part 137 and the auxiliary limit part 138 are locked on the bottom surface of the bed plate 121, and the rotating member 131 and the auxiliary rotating member 135 abut against the limit part 137 and the auxiliary limit part 138, respectively. When the driving unit 140 is actuated, the rotating member 131 rolls within the range of the limit part 137, and the auxiliary rotating member 135 rolls within the range of the auxiliary limit part 138. It is noticed that, the limit part 137 and the auxiliary limit part 138 may be implemented as a material that helps rolling, such as a metal material, so the limiting portion 137 and the auxiliary limiting portion 138 may be implemented as metal iron pieces.

Afterwards, the connector 150 includes a rotating member 151, multiple connecting arms 152 and 154, a transmission bar 153, an auxiliary rotating member 155 and an auxiliary connecting arms 156. The rotating member 151 is pivotally connected with the connecting arm 152. The connecting arm 152 is sleeved with the transmission bar 153 and fixed relative to each other. The connecting arm 154 is sleeved with the transmission bar 153 and fixed relative to each other. The auxiliary rotating member 155 is pivotally connected to the auxiliary connecting arm 156. The auxiliary connecting arm 156 is sleeved with the transmission bar 153 and fixed relative to each other. The driving unit 160 is arranged to drive the transmission bar 153 to rotate, and the transmission bar 153 is arranged to drive the connecting arm 152 and the auxiliary connecting arm 156 to adjust the bed plate 123. Similarly, the transmission bar 153, the connecting arms 152 and 154, and the auxiliary connecting arm 156 are relatively fixed to each other. Therefore, when the driving unit 160 is actuated, the transmission bar 153 is driven to rotate and the connecting arm 152 and the auxiliary connecting arm 156 are driven to adjust the raising or lowering of the bed plate 123.

Afterwards, the limit part 157 and the auxiliary limit part 158 are locked on the bottom surface of the bed plate 123, and the rotating member 151 and the auxiliary rotating member 155 abut against the limit part 157 and the auxiliary limit part 158, respectively. When the driving unit 160 is actuated, the rotating member 151 rolls within the range of the limit part 157, and the auxiliary rotating member 155 rolls within the range of the auxiliary limit part 158. It is noticed that, the limit part 157 and the auxiliary limit part 158 may be implemented as a material that helps rolling, such as a metal material, so the limiting portion 157 and the auxiliary limiting portion 158 may be implemented as metal iron pieces.

Afterwards, the driving unit 140 is fixedly connected with the bed stand 111A, and the driving unit 160 is fixedly connected with the bed stand 111B. The driving units 140 and 160 are electrically connected to a processor (not shown in FIG. 3), and the processor is configured to provide the control signals to the driving units 140 and 160. Therefore, the user can utilize the control interface (not shown in FIG. 3) to provide a controlling signal to control the angle of the bed plate. It is noticed that, the user can utilize the control interface to control different driving units to adjust the angle of different bed plates. The control interface be implemented as the remote control or the Apps of mobile device.

Figure 4:
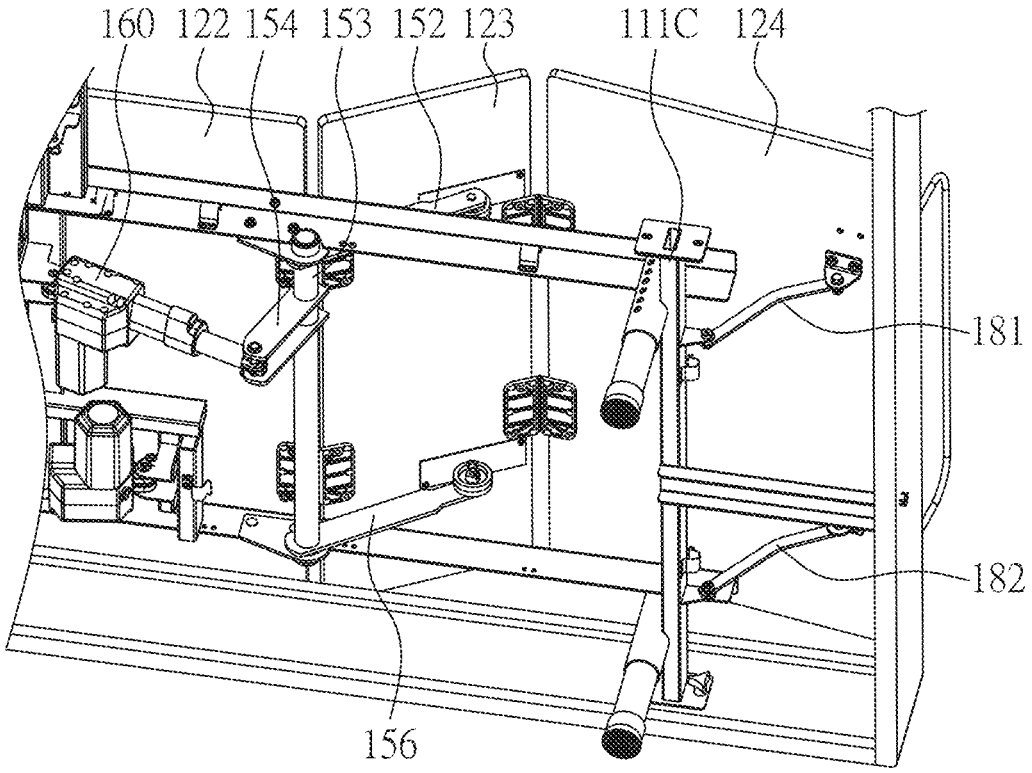
FIG. 4 is a partially enlarged stereogram illustrating an electrical bed according to an embodiment of the disclosure.

Reference is made to FIG. 4, which is a partially enlarged stereogram illustrating an electrical bed 100 according to an embodiment of the disclosure. As shown in FIG. 4, the electrical bed 100 further includes a plurality of extension support frames 181 and 182. One end of the extension support frames 181 and 182 are respectively pivotally connected with the bed stand 111C, and another end of the extension support frames 181 and 182 are respectively pivotally connected with the bed plate 124. It is noticed that, when the driving unit 160 is actuated, the connecting arm 152 and the auxiliary connecting arm 156 are driven to adjust the raising or lowering of the bed plate 123, and the bed plate 124 is driven to adjust the angle of bed plate 124.

Figure 5:
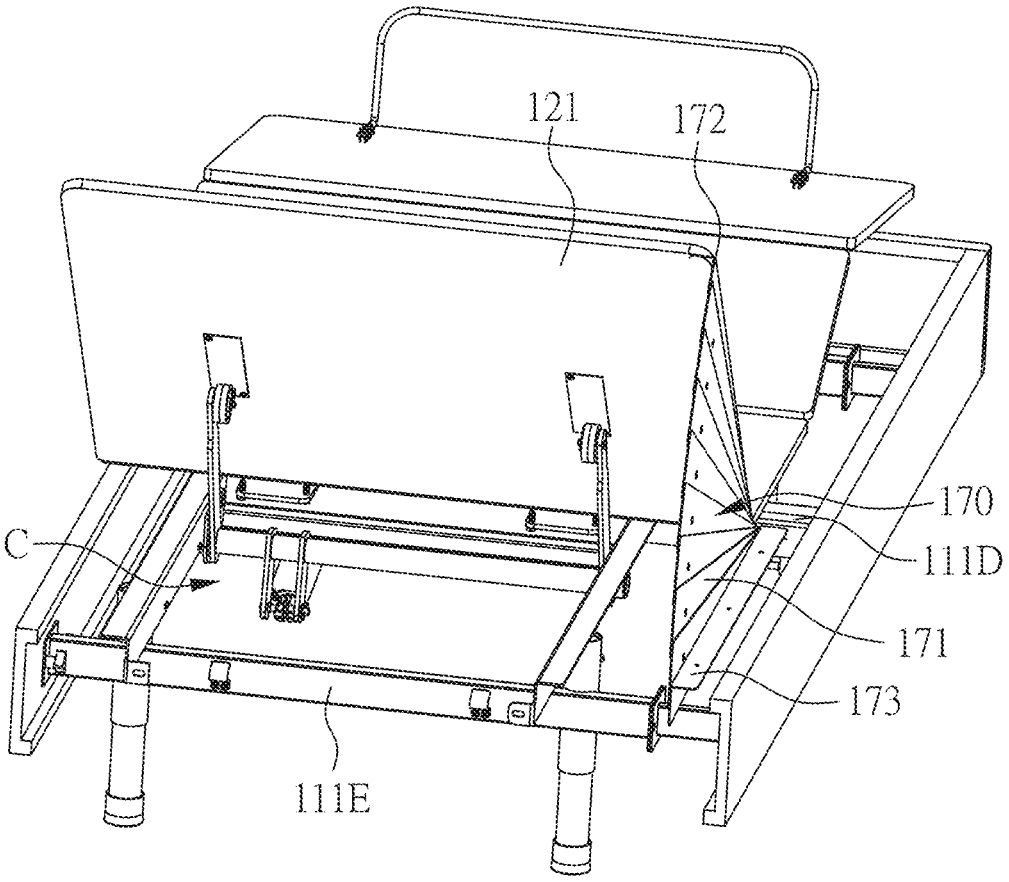
FIG. 5 is a partially enlarged stereogram illustrating an electrical bed according to an embodiment of the disclosure.

Reference is made to FIG. 5, which is a partially enlarged stereogram illustrating an electrical bed 100 according to an embodiment of the disclosure. As shown in FIG. 5, the electrical bed 100 further includes a blocker member 170, and the blocker member 170 is disposed to a side of the bed plate 121. In another embodiment, the blocker member 170 also can dispose to a side of the bed plate 124, or the blocking members 170 are provided on both the side of the bed plate 121 and the side of the bed plate 124. However, the disclosure is not limited thereto. The blocker member 170 includes multiple blocker units 171 and multiple connecting units 172 and 173. The one end of the blocker units 171, the one end of the connecting unit 172 and one end of the connecting unit 173 are pivotally connected to each other. The connecting unit 172 is fixedly connected to the side of the bed plate 121, and the connecting unit 173 is fixedly connected to the bed stands 111D and 111E.

Afterwards, when the driving unit 140 is configured to adjust the bed plate 121 to an unfolding position, the connecting unit 171 is driven to pivot to the unfolding position, and the blocker units 171 are configured to pivot and unfold between the connection units 172 and 173. When the blocker units 171 is pivoted to an unfolding position, it can prevent the object (e.g. animals or children) from falling into the space C where the bed plate 121 is raised, and the blocker member 170 can prevent the accident of pinch injury. When the driving unit 140 is configured to adjust the bed plate 121 to a closed position, the blocker member 170 will be folded on the side of the bed 121. In another embodiment, the bed size of the electrical bed 100 can be implemented as the double size. However, the disclosure is not limited thereto.

Based on aforesaid embodiments, the electrical bed are capable of providing the electrical bed for adjusting different angles of the bed plates; adjusting the bed plates to change the angle of the mattress. In some embodiments, this disclosure is able to achieve the effect of conforming to the sleeping position of the user to improve the quality of the user's sleep.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An electrical bed, comprising:

a frame including a plurality of bed stands;

a plurality of bed plates disposed on the bed stands;

a first connector including a first rotating member, a first connecting arm, a first transmission bar and a second connecting arm, wherein the first rotating member is pivotally connected with the first connecting arm; the first connecting arm is sleeved with the first transmission bar and fixed relative to each other, and the second connecting arm is sleeved with the first transmission bar and fixed relative to each other; the first rotating member abuts against one of the bed plates;

a first driving unit fixedly connected with one of the bed stands and pivotally connected with the second connecting arm; and a blocker member disposed to a side of one of the bed plates, wherein the blocker member includes a plurality of blocker units, a first connecting unit and a second connecting unit; one end of the blocker units, one end of the first connecting unit and one end of the second connecting unit are pivotally connected to each other, and each blocker unit of the plurality of blocker units is parallel to a directly adjacent blocker unit of the plurality of blocker units;

wherein the first connecting unit is fixedly connected to the side of one of the bed plates, the second connecting unit is fixedly connected to the bed stands, and wherein the first driving unit is arranged to drive the first transmission bar to adjust one of the bed plates.

2. The electrical bed of claim 1, wherein the bed plates include a first bed plate, a second bed plate, a third bed plate and a fourth bed plate; wherein the first bed plate is pivotally connected to the second bed plate through a first hinge; the second bed plate is pivotally connected to the third bed plate through a second hinge, and the third bed plate is pivotally connected to the fourth bed plate through a third hinge.

3. The electrical bed of claim 2, wherein the first connector includes a limit part, and the limit part is locked on the bottom surface of the first bed plate; the first rotating member abuts against the limit part, and the first rotating member rolls within the range of the limit part.

4. The electrical bed of claim 3, wherein the first connector further includes an auxiliary rotating member, an auxiliary connecting arm and an auxiliary limit part, wherein the auxiliary rotating member is pivotally connected to the auxiliary connecting arm; the auxiliary connecting arm is sleeved with the first transmission bar and fixed relative to each other; the auxiliary limit part is locked on the bottom surface of the first bed plate; the auxiliary rotating member abuts against the auxiliary limit part, and the auxiliary rotating member rolls within the range of the auxiliary limit part.

5. The electrical bed of claim 2, further comprising:

a second connector including a second rotating member, a third connecting arm, a second transmission bar, a fourth connecting arm and a limit part, wherein the second rotating member is pivotally connected with the third connecting arm; the third connecting arm is sleeved with the second transmission bar and fixed relative to each other, and the fourth connecting arm is sleeved with the second transmission bar and fixed relative to each other; the limit part is locked on the bottom surface of the third bed plate; the second rotating member abuts against the limit part, and the second rotating member rolls within the range of the limit part.

6. The electrical bed of claim 5, further comprising:

a second driving unit fixedly connected with another one of the bed stands and pivotally connected with the fourth connecting arm; wherein the second driving unit is arranged to drive the second transmission bar to adjust the third bed plate.

7. The electrical bed of claim 6, wherein the second connector further includes an auxiliary rotating member, an auxiliary connecting arm and an auxiliary limit part, wherein the auxiliary rotating member is pivotally connected to the auxiliary connecting arm; the auxiliary connecting arm is sleeved with the second transmission bar and fixed relative to each other; the auxiliary limit part is locked on the bottom surface of the third bed plate; the auxiliary rotating member abuts against the auxiliary limit part, and the auxiliary rotating member rolls within the range of the auxiliary limit part.

8. The electrical bed of claim 6, further comprising:

a plurality of extension support frames, one end of the extension support frames are respectively pivotally connected with one of the bed stands, and another end of the extension support frames are respectively pivotally connected with the fourth bed plate.

9. The electrical bed of claim 8, wherein the second driving unit is arranged to drive the second transmission bar to adjust the third bed plate and the fourth bed plate.

10. The electrical bed of claim 1, wherein when the first driving unit is configured to adjust one of the bed plates to an unfolding position, the first connecting unit is driven to pivot to the unfolding position, and the blocker units are configured to pivot and unfold between the first connection unit and the second connection unit.

* * * * *